US009726014B2

(12) United States Patent
Khajeh et al.

(10) Patent No.: US 9,726,014 B2
(45) Date of Patent: Aug. 8, 2017

(54) GUIDED WAVE DOWNHOLE FLUID SENSOR

(71) Applicant: Baker Hughes Incorporated, Houston, TX (US)

(72) Inventors: Ehsan Khajeh, Spring, TX (US); Roger R. Steinsiek, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 142 days.

(21) Appl. No.: 14/271,256

(22) Filed: May 6, 2014

(65) Prior Publication Data

US 2015/0322782 A1 Nov. 12, 2015

(51) Int. Cl.

| | |
|---|---|
| ***E21B 49/10*** | (2006.01) |
| ***E21B 49/08*** | (2006.01) |
| ***E21B 3/00*** | (2006.01) |
| ***E21B 47/00*** | (2012.01) |
| ***E21B 47/01*** | (2012.01) |
| ***E21B 47/14*** | (2006.01) |

(52) U.S. Cl.

CPC ..... *E21B 49/10* (2013.01); *E21B 3/00* (2013.01); *E21B 47/0005* (2013.01); *E21B 47/01* (2013.01); *E21B 47/011* (2013.01); *E21B 47/14* (2013.01); *E21B 49/08* (2013.01)

(58) Field of Classification Search

CPC ..... E21B 44/06; E21B 47/065; E21B 47/16
USPC ..... 166/250.01
See application file for complete search history.

(56) References Cited

U.S. PATENT DOCUMENTS 6,084,826 A 7/2000 Leggett, III
6,575,043 B1 6/2003 Huang et al.
(Continued)

FOREIGN PATENT DOCUMENTS

WO 2004046506 A1 6/2004

OTHER PUBLICATIONS

Vol'Kenshtein, M.M. and Levin, M.M., "Structure of a stoneley wave at an interface between a viscous fluid and a solid," Akusticheskij Zhurnal 34, pp. 608-615 (Jul.-Aug. 1988); (published in English in Sov. Phys. Acoust. 34(4), pp. 351-355 (1989).
(Continued)

*Primary Examiner* — Angela M DiTrani
*Assistant Examiner* — Ashish Varma
(74) *Attorney, Agent, or Firm* — Mossman, Kumar & Tyler, PC

(57) ABSTRACT

Methods, systems, and devices for downhole evaluation using a sensor assembly that includes a sensor plate, wherein a surface of the sensor plate forms a portion of an exterior surface of a downhole tool. Methods may include submerging the surface of the sensor plate in a downhole fluid in a borehole; activating the sensor assembly to generate a guided wave that propagates along the sensor plate, wherein propagation of the guided wave along the sensor plate is dependent upon a parameter of interest of the downhole fluid; and using information from the sensor assembly relating to the propagation of the guided wave along the sensor plate to estimate the parameter of interest. Methods may include isolating an opposing surface of the sensor plate from the downhole fluid. The guided wave may be an interface guided wave or may propagate in the plate between the surface and an opposing surface.

19 Claims, 11 Drawing Sheets

(56) References Cited

U.S. PATENT DOCUMENTS

| | | | | |
|---|---|---|---|---|
| 2005/0000279 | A1 | 1/2005 | Yogeswaren | |
| 2007/0005251 | A1* | 1/2007 | Chemali | G01V 1/50 702/6 |
| 2009/0257307 | A1* | 10/2009 | Valero | G01V 1/50 367/31 |
| 2011/0271769 | A1* | 11/2011 | Kippersund | G01F 1/42 73/861.28 |

OTHER PUBLICATIONS

Martin, Bret A., et al., "Viscosity and Density Sensing With Ultrasonic Plate Waves," Sensors and Actuators, A21-23 pp. 704-708 (1990).

Favretto-Anres, N., et al., "Excitation of the Stoneley-Scholte Wave at the Boundary Between an Ideal Fluid and a Viscoelastic Solid," Jnl of Sound & Vibration 203(2), pp. 193-208 (1997).

Shepard, Chester L., et al., "Measurements of Density and Viscosity of One- and Two-Phase Fluids With Torsional Waveguides," IEEE Transactions on Ultrasonics, Ferroelectrics, and Frequency Control., vol. 46, No. 3, pp. 536-548 (May 1999).

Glorieux, Christ et al., "On the character of acoustic waves at the interface between hard and soft solids and liquids," J. Acoust. Soc. Am 110 (3) Pt. 1, pp. 1299-1306 (Sep. 2001).

Vogt, Thomas K., et al., "Measurement of the Material Properties of Viscous Liquids Using Ultrasonic Guided Waves," IEEE Transactions on Ultrasonics, Ferroelectrics, and Frequency Control., vol. 51, No. 6, pp. 737-747 (Jun. 2004).

Int'l Search Report and Written Opinion in PCT/US2015/029238, dtd Jul. 29, 2015.

* cited by examiner

GUIDED WAVE DOWNHOLE FLUID SENSOR

FIELD OF THE DISCLOSURE

This disclosure generally relates to downhole fluids, and in particular to methods and apparatus for estimating a parameter of interest of a downhole fluid.

BACKGROUND OF THE DISCLOSURE

Determining the acoustic properties of downhole fluids may be desirable for several types of downhole evaluation. Such properties may be used in characterizing the fluid itself, or for use in methods for evaluating the formation, the borehole, the casing, the cement, or for previous or ongoing operations in the borehole including exploration, development, or production.

As one example, it is known to conduct acoustic inspection of a casing cemented in a borehole to determine specific properties related to the casing and surrounding materials. For example, the bond between the cement and the casing may be evaluated, or the strength of the cement behind the casing or the casing thickness may be estimated, using measurements of reflected acoustic waves, which may be generally referred to as casing cement bond logging. Physical properties of fluids vary at different depths of a well. Thus, for many of these techniques, it is desirable that variations in the fluid filling the borehole (e.g., drilling fluid) be compensated for, because conventional processing is highly sensitive to the properties of the fluid. So as one example, localized estimation of downhole fluid impedance may be desirable to enable accurate interpretation of downhole casing inspection measurements.

Thus, various techniques are currently employed to determine parameters of the fluid affecting acoustic measurements, such as acoustic impedance and sound velocity in order to interpret the acoustic reflection data. Traditionally, time of flight of the acoustic signals has been used to determine sound velocity, and additional measurements may be used to estimate at least one of acoustic impedance and density of the fluid.

SUMMARY OF THE DISCLOSURE

In aspects, the present disclosure is related to methods and apparatuses for estimating at least one parameter of interest of a downhole fluid relating to an earth formation intersected by a borehole.

Aspects of the disclosure include methods of downhole evaluation using a sensor assembly that includes a sensor plate, wherein a surface of the sensor plate forms a portion of an exterior surface of a downhole tool. General method embodiments according to the present disclosure may include submerging the surface of the sensor plate in a downhole fluid in a borehole; activating the sensor assembly to generate a guided wave that propagates along the sensor plate, wherein propagation of the guided wave along the sensor plate is dependent upon a parameter of interest of the downhole fluid; using information from the sensor assembly relating to the propagation of the guided wave along the sensor plate to estimate the parameter of interest. Methods may include isolating at least an opposing surface of the sensor plate from the downhole fluid. The information may relate to attenuation of the guided wave. The guided wave may propagate in the plate between the surface and an opposing surface of the plate. The guided wave may be an interface guided wave. The information may relate to time of flight of the guided wave along the interface between the surface and the downhole fluid.

The tool may be conveyed on a drillstring having a drillbit disposed at the distal end thereof and the downhole fluid comprises drilling fluid. Methods may include rotating the drillbit to extend the borehole; and circulating drilling fluid in the borehole. The sensor assembly may include an acoustic transmitter acoustically coupled to the plate, and the sensor assembly may include at least one acoustic receiver acoustically coupled to the plate. Methods may include generating the guided wave with the acoustic transmitter and/or generating the information with the at least one acoustic receiver in response to the propagating guided wave. At least one of the acoustic transmitter and the acoustic receiver may be contained in compensation fluid.

The sensor assembly may include at least a first acoustic receiver coupled to the plate at a first distance along the plate from the acoustic transmitter and a second acoustic receiver coupled to the plate at a second distance along the plate from the acoustic transmitter, wherein the first distance and the second distance are not the same. Methods may include generating the information in response to the propagating guided wave with at least the first acoustic receiver and the second acoustic receiver.

The plate may include a reservoir between the first acoustic receiver and the second acoustic receiver to mitigate non-interface waves. The reservoir may contain another acoustic transmitter configured to generate non-interface waves in the plate. The guided wave may be at least one of i) a Lamb wave; and ii) a Scholte wave.

Methods may include identifying a value of the parameter of interest by matching the information to an analytical solution. The parameter of interest may be at least one of: i) sound velocity of the downhole fluid; ii) acoustic impedance of the downhole fluid; and iii) density of the downhole fluid. Methods may include using the parameter of interest for casing cement bond logging.

Aspects of the disclosure include apparatus for downhole evaluation in a borehole intersecting an earth formation. Apparatus embodiments may include a carrier configured to be conveyed into a borehole filled with downhole fluid; a logging tool mounted on the carrier, the logging tool including: a plate having an exterior surface configured to be submerged in the downhole fluid; a transmitter coupled to the plate; at least one receiver coupled to the plate; at least one processor configured to: use the transmitter to excite a guided wave in the plate; use information from the at least one receiver relating to propagation of the guided wave along the plate to estimate the parameter of interest. The logging tool may be configured such that when the borehole is filled with downhole fluid, the surface is immersed in the downhole fluid.

Further embodiments may include a non-transitory computer-readable medium product having instructions thereon that, when executed, cause at least one processor to perform a method as described above. The non-transitory computer-readable medium product may include at least one of: (i) a ROM, (ii) an EPROM, (iii) an EEPROM, (iv) a flash memory, or (v) an optical disk.

Examples of some features of the disclosure may be summarized rather broadly herein in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
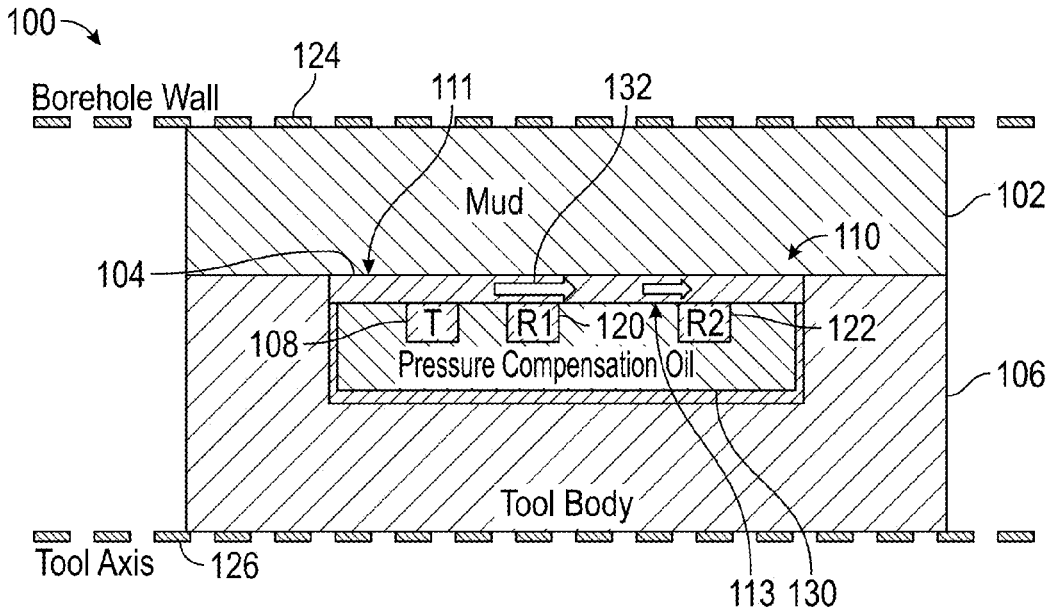
FIG. 1 shows a tool in accordance with embodiments of the present disclosure.

In aspects, this disclosure relates to estimating a parameter of interest of a downhole fluid in an earth formation intersected by a borehole. The at least one parameter of interest may include, but is not limited to, one or more of: (i) sound velocity of the fluid, (ii) acoustic impedance of the fluid, (iii) density of the fluid.

Various techniques have been used to analyze downhole fluids. Such techniques may include the use of instruments for obtaining information relating to a parameter of interest in conjunction with sample chambers storing the sampled fluid for analysis or sample chambers allowing the fluid to pass through (continuously, or as directed by a flow control) for sampling, or as mounted on an exterior of a tool body of a downhole tool. Example systems may use a signal generator and sensor (which may be combined; e.g., a transducer) for determining acoustic impedance, sound velocity, or other parameters of interest. In the well-known time of flight method, the sound velocity, c, of a fluid may be determined by dividing the travel time of the signal through the fluid by the distance the signal traveled through the fluid. Other methods have been used to analyze fluids at the surface.

Previous methods of estimation are difficult to implement downhole due to low accuracy, limitations in downhole space, and troublesome mechanical load reliability. Implementation in a logging-while-drilling ('LWD') tool, where the above issues are exacerbated, has proven to be especially problematic. Many approaches introduce a cavity in the tool surface, which consequently may be blocked by debris, which negatively affects measurement accuracy. For example, traditional methods introducing a cavity may show 30 percent error for impedance and 10 percent error (or more) for fluid velocity.

Thus, it would be desirable to reduce the size of the measurement apparatus on a downhole tool, particularly Measurement-While-Drilling ('MWD') and Logging-While-Tripping ('LWT') tools. Design considerations for instruments used in MWD and LWT tools are particularly demanding in terms of dimensional specifications. Various tradeoffs may be accepted in terms of design. As one example, a smaller sensor consistent with traditional techniques may be obtained by using a higher frequency transducer, but drilling fluids tend to be full of particles that cause dramatic signal attenuation in the fluid with increasing frequency. For particle-laden drilling fluid, according to particular configurations, an upper limit for frequency may be 250 kHz or 500 kHz for transmission with acceptable attenuation through approximately 25 mm of drilling mud. Thus, configuring a traditional time-of-flight instrument for use in an MWD or LWT tool or in other space-restrictive downhole applications can be problematic.

Aspects of the present disclosure use guided waves to determine characteristics of a downhole fluid, such as, for example, acoustic impedance and sound velocity. A "guided wave," as used herein, refers to an acoustic wave transmitted by a process that excites a propagating acoustic wave between two mechanical boundaries or along the interface of two materials (waveguide). The wave is characterized by one or more boundaries of propagation defined by a solid-solid, solid-liquid, or solid-gas mechanical configuration. Thus, the energy of a guided wave is concentrated near a boundary or between parallel boundaries separating different materials and that has a direction of propagation parallel to these boundaries.

General method embodiments include downhole evaluation using a sensor assembly that includes a sensor plate, wherein a surface of the sensor plate forms a portion of an exterior surface of a downhole tool. Methods may include submerging the surface of the sensor plate in a downhole fluid in a borehole; activating the sensor assembly to generate a guided wave that propagates along the sensor plate, wherein propagation of the guided wave along the sensor plate is dependent upon a parameter of interest of the downhole fluid; and using information from the sensor assembly relating to the propagation of the guided wave along the sensor plate to estimate the parameter of interest.

Various parameters of interest may be estimated using the sensor assembly. Acoustic impedance of the downhole fluid may be estimated by measuring attenuation of a guided wave propagating along the plate. Sound velocity of the downhole fluid may be estimated by measuring the speed of propagation of specific guided waves along an interface of the plate and the downhole fluid. Techniques employed herein exhibit increased accuracy in comparison to traditional approaches. Further, the small thickness of the sensor assembly allows trouble-free implementation in downhole LWD and wireline tools.

FIG. 1 shows a tool in accordance with embodiments of the present disclosure. In FIG. 1, the tool 100, with tool axis 126, includes a tool body 106 having incorporated therein a sensor assembly 110. The sensor assembly 110 includes a sensor plate 104 at the exterior of the tool body 106, an acoustic transmitter 108, a first acoustic receiver 120 and a second acoustic receiver 122, and control circuitry (not shown) for operating the transmitter and receivers.

The sensor plate 104 includes a surface 111 forming an exterior surface of the tool 100. Sensor plate 104 may be at the circumference of the tool body 106. The tool 100 is configured such that the surface 111 is submerged in a downhole fluid 102 (e.g., drilling mud) upon the tool being submerged. That is, the surface 111 is in contact with (immersed in) the downhole fluid 102 while the tool 100 is conveyed in a fluid filled borehole 124. The tool 100 may also isolate an opposing surface 113 of the sensor plate 104 from the downhole fluid 102, as shown here. Alternatively, the sensor plate 104 may have multiple surfaces in contact with the fluid. If isolated, the opposing surface 113 may be in contact with a compensation fluid 130 (e.g., oil), so that the sensor plate 104 is exposed to fluid 102 on one side and compensation fluid on the other.

Acoustic transmitter 108 (e.g. a transducer) may be positioned at a first location towards a first end of the sensor plate 104 and configured to generate a pulse in the sensor plate 104. Receivers 120 and 122 (e.g., transducers) may be located at known predefined distances from one another and from the transmitter 108. Transducers used in transmitter 108 and receivers 120 and 122 may be any appropriate transducer, such as, for example, piezoelectric transducers, magnetostrictive transducers, and so on, as will occur to one of skill in the art. In embodiments, transducers may be electromagnetic acoustic transducers ('EMATs'). The transmitter 108 may be a narrow band transducer with a central frequency at approximately 500 kHz.

Transmitter 108 is configured, in response to excitation of the transmitter 108 by control circuitry, to generate a guided wave 132 that propagates within the plate 104. That is, the guided wave is propagating along the plate 104 parallel with the longitudinal axis of the tool. In other embodiments, the plate 104 may be configured and oriented such that the guided wave propagates along the plate 104 tangent to the tool circumference. Receivers 120 and 122 are configured to detect the propagating wave at their respective locations, and may also be optimized to receive 500 kHz. The configuration may be referred to as a pitch-catch configuration.

In operation, behavior of the guided wave may be used to estimate a related parameter of interest of the system (including the tool, borehole and earth formation), such as, for example, parameters of interest of the downhole fluid. Information from the receivers 120 and 122 corresponding to detection of the guided wave may be indicative of wave behavior (e.g., time-of-flight or attenuation). The particular aspects of wave behavior to be estimated may correspond to the parameter of interest to be estimated.

Embodiments may use attenuation of guided waves in the sensor plate 104 to estimate the acoustic impedance of a fluid ('fluid impedance') using a model relating attenuation magnitude (e.g., differences in estimated attenuation at locations along the plate) with fluid impedance. As the sensor plate 104 is exposed to the downhole fluid 102, during the propagation, some of the energy of the guided wave leaks to fluids with which it is in contact, namely, the downhole fluid 102 (and in particular embodiments, compensation fluid 132). The amount of leakage, corresponding to the magnitude of the guided wave attenuation, is dependent upon fluid density and sound velocity of the fluid 102. The particular configuration of tool 100 may correspond to the parameter of interest to be estimated as well as an anticipated environment of the borehole, e.g., a predicted range for the parameter of interest.

TABLE 1 impedance and velocity range for mud and compension oil.

| Mud Impedance | Min. | Max. |
|---|---|---|
| | 0.8 [Mrayl] | 3.5 [Mrayl] |
| Water Base Mud | Min | Max |
| Density<br>Sound velocity | 1000 [kg/m^3]<br>1300 [m/s] | 1200 [kg/m^3]<br>1700 [m/s] |
| Oil Base Mud | Min | Max |
| Density<br>Sound velocity | 800 [kg/m^3]<br>1000 [m/s] | 1700 [kg/m^3]<br>2000 [m/s] |
| Compensation Oil | Density | Sound Velocity |
| Hydraunycoil FH 4725 | 900 [kg/m^3] | 1200 [m/s] |

Figure 2A:
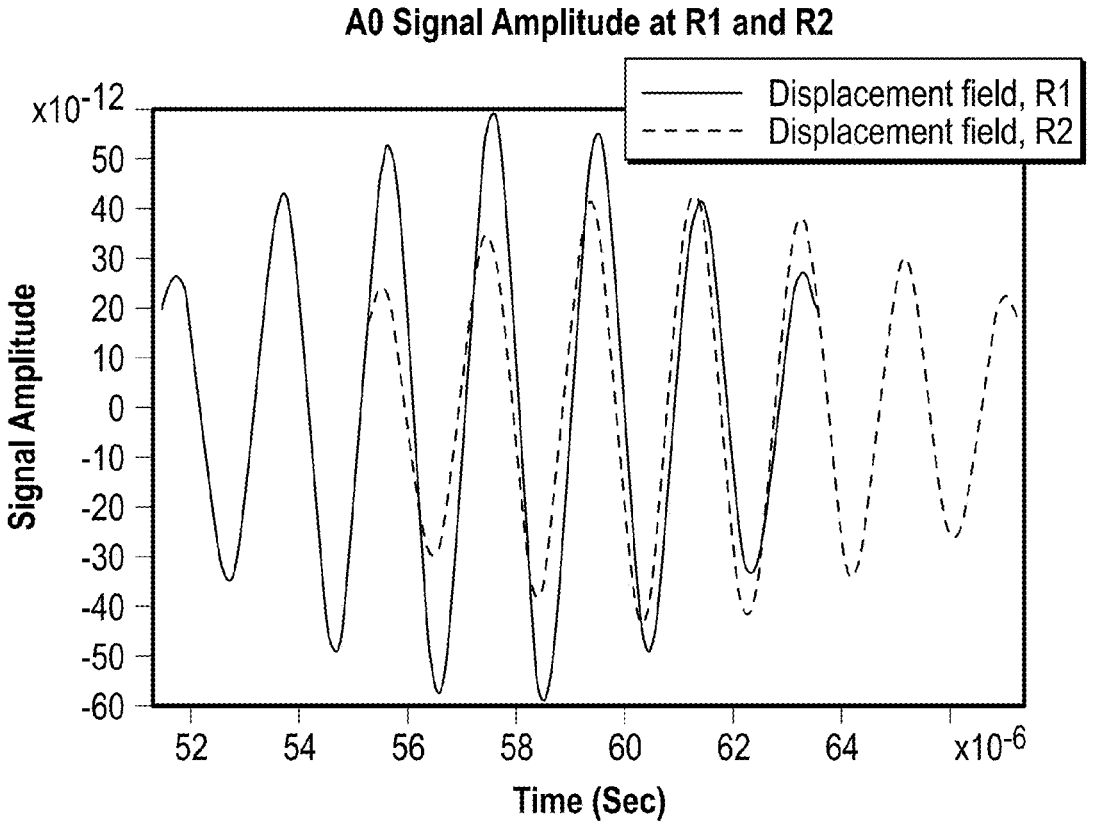
FIG. 2A illustrates a difference in signal amplitude indicative of attenuation in accordance with embodiments of the present disclosure.
Figure 2B:
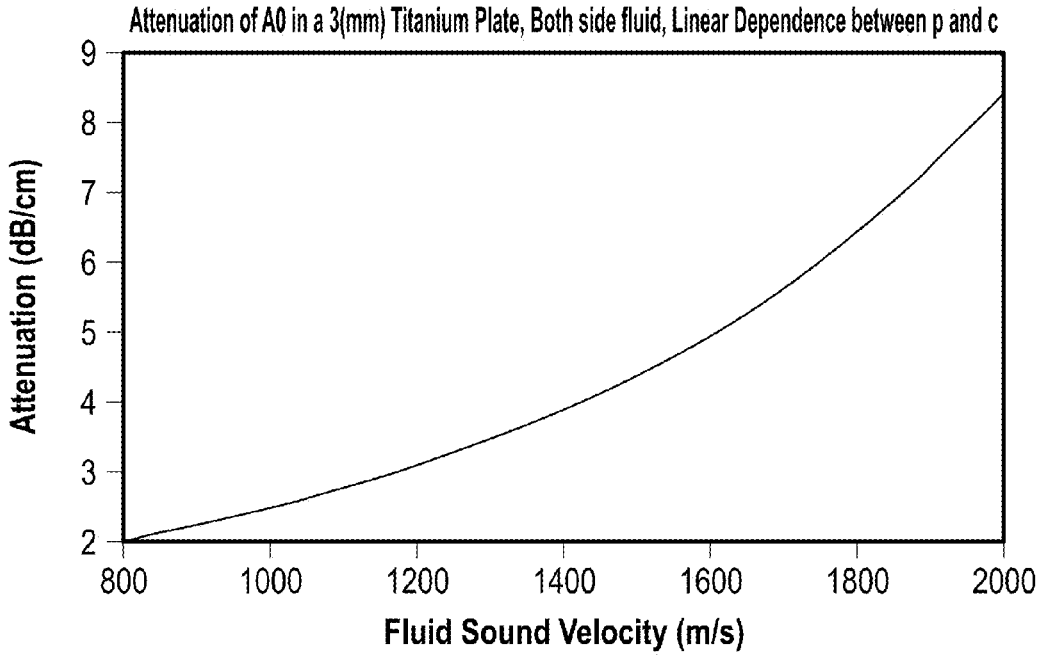
FIGS. 2B-2D illustrate attenuation and phase velocity dispersion characteristics of a guided wave for a 3 millimeter titanium plate with respect to frequency.
Figure 2C:
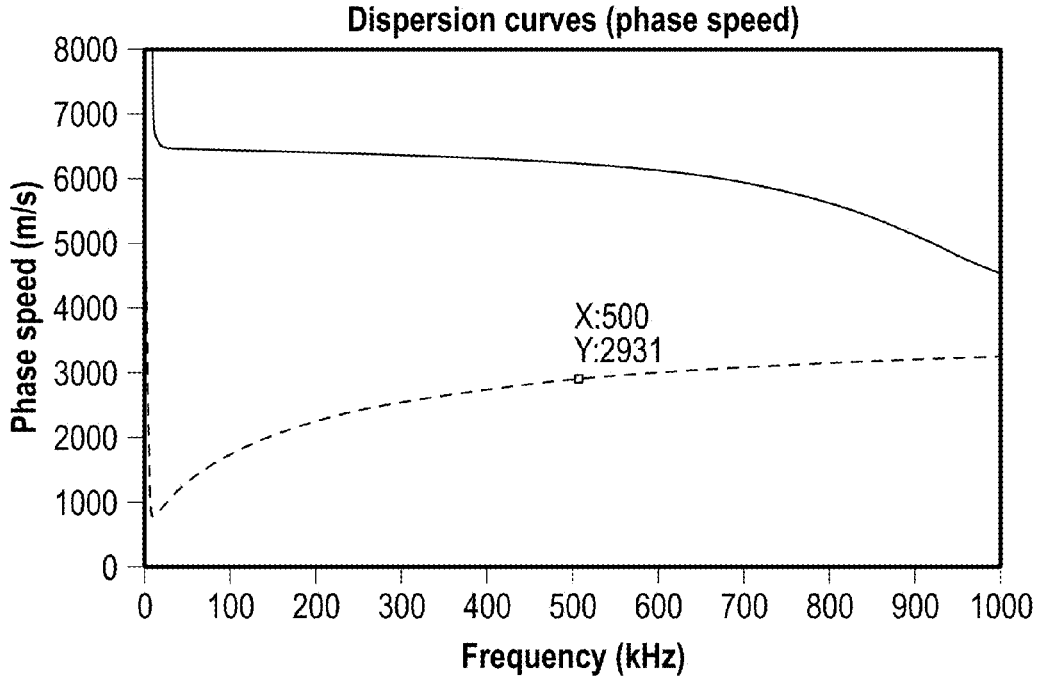
Figure 2D:
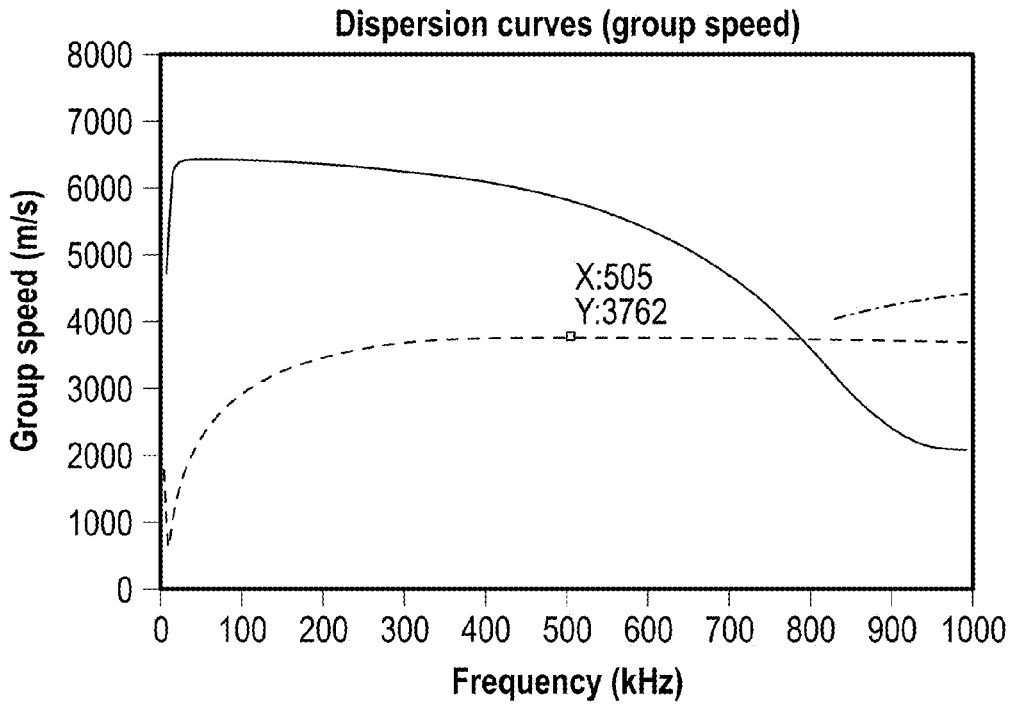

FIG. 2A illustrates a difference in signal amplitude indicative of attenuation in accordance with embodiments of the present disclosure. FIGS. 2B-2D illustrate attenuation and phase velocity dispersion characteristics of a guided wave for a 3 millimeter titanium plate with respect to frequency. Attenuation may be estimated using differences in measurements from receiver 120 and receiver 122. Attenuation magnitude is dependent upon plate material and thickness, and guided wave mode and frequency, which are all known, as well as fluid density and fluid sound velocity. The properties of the compensation fluid may be incorporated in the model as necessary.

In particular embodiments, leaky Lamb waves (guided waves that propagate in the plate between the surface in contact with the downhole fluid and the opposing surface of the plate) have been shown to be suitable guided waves for this technique. A large portion of the leaky Lamb wave energy is leaked out of the plate. Therefore, the waves are highly attenuative. FIGS. 2A-2D correspond to leaky Lamb waves.

Figure 3:
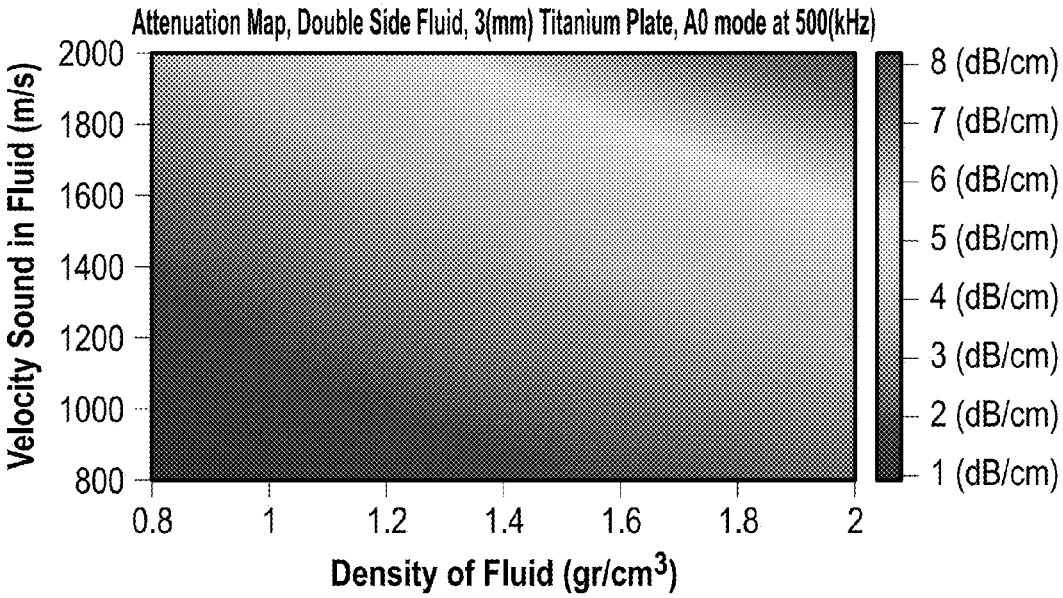
FIG. 3 illustrates attenuation of the A0 mode of the Lamb wave at 500 kHz in dependence upon fluid density and sound velocity for a titanium plate having both sides immersed in fluid.

FIG. 3 illustrates attenuation of the A0 mode of the Lamb wave at 500 kHz in dependence upon fluid density and sound velocity for a titanium plate having both sides immersed in fluid. The A0 mode may be desirable to provide a combination of high excitability, high attenuation, and a wide range of attenuation in the impedance range. The excitation of a pure A0 mode can be achieved with an EMAT transducer with suitable coil spacing or angle beam transducer with suitable angle. A frequency of around 500 kHz may be selected; this frequency is well-suited to produce high attenuation and non-dispersive behavior for the A0 mode. It also may be desirable that the phase velocity (Cp) of the A0 mode in the plate around the selected frequency is greater than the maximum anticipated fluid velocity for the tested fluid, which is the case for typical drilling fluids at 500 kHz. Frequencies above 200 kHz may further be preferable to enable smaller sensor design.

Figure 4A:
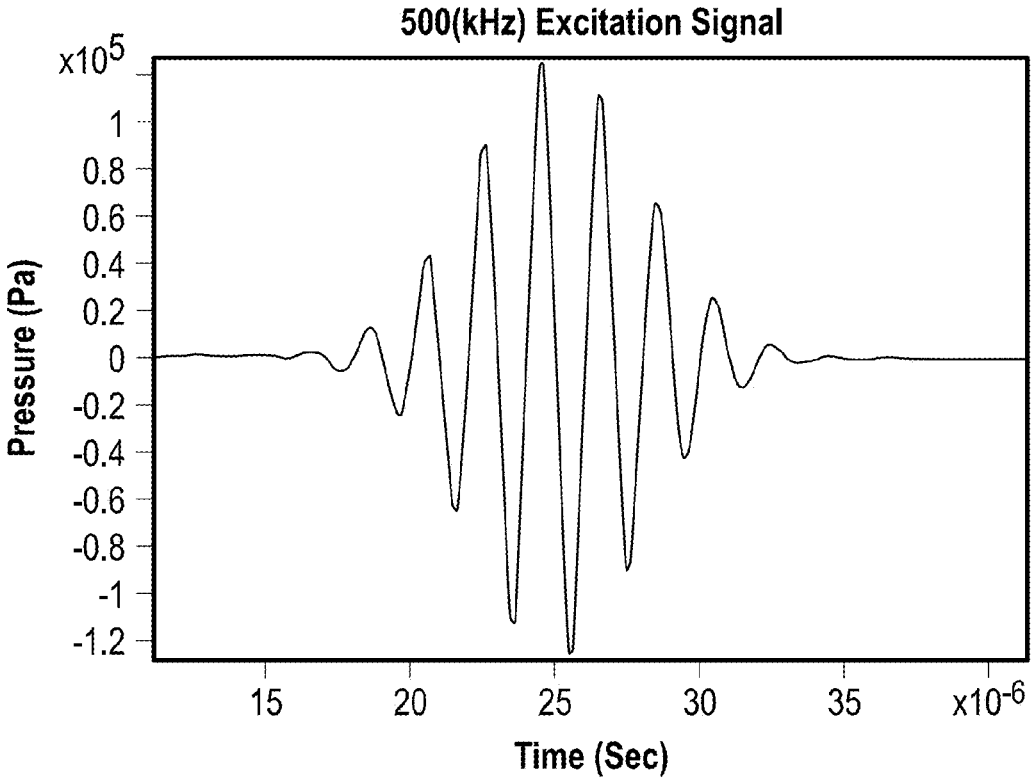
FIG. 4A shows a pulse of the excitation signal having seven cycles.
Figure 4B:
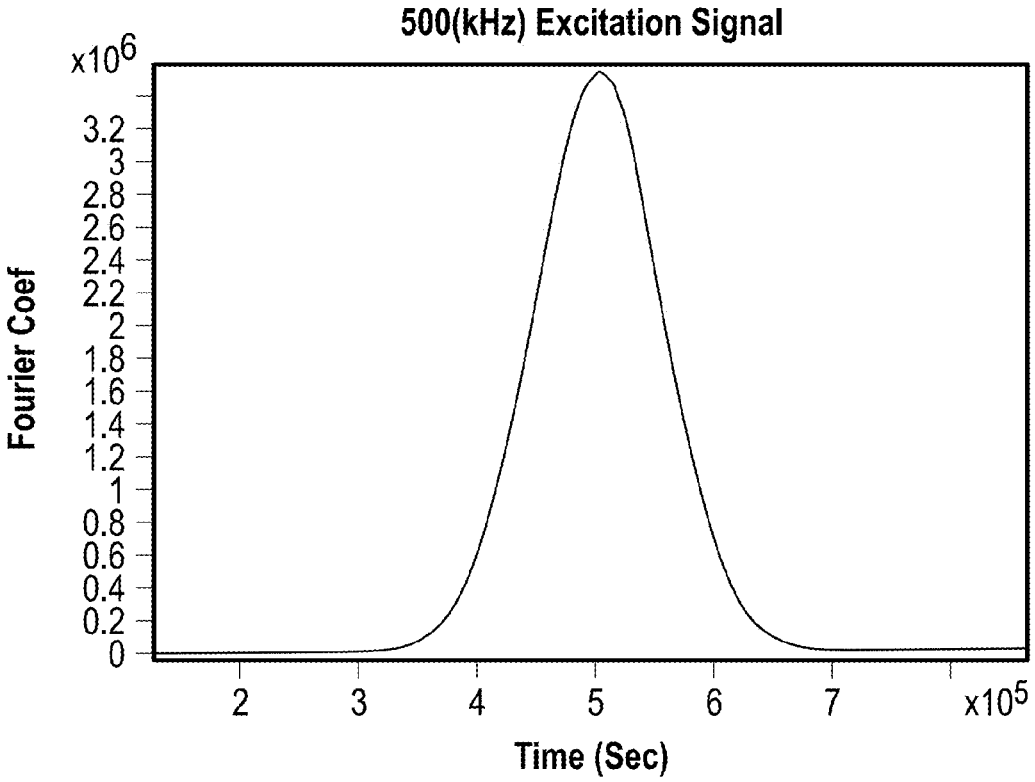
FIG. 4B illustrates the frequency spectrum of an excitation signal in accordance with embodiments of the present disclosure.

FIGS. 4A and 4B illustrate an excitation signal in accordance with embodiments of the present disclosure. In particular embodiments, the excitation signal of the transmitter 108 may have certain characteristics beneficial to estimation of the parameter of interest. For example, it may be beneficial to restrict the bulk of the energy transmitted in a narrow band around the selected transmission frequency. FIG. 4A shows a pulse of the excitation signal having seven cycles. A pulse having 5-10 cycles may be beneficial. It may also be beneficial for the pulse length to be less than 20 microseconds to prevent signal overlapping. FIG. 4B illustrates the frequency spectrum of an excitation signal in accordance with embodiments of the present disclosure.

The specific dimensions and material of the sensor plate may be environment and application specific. The plate may be configured such that reflections from ends of the plate do not overlap with the primary signal, and the width facilitates retaining sufficient energy for a 3D waveguide. The thickness of the plate may be configured to optimize frequency and dispersion curves. For example, in one implementation, the plate may be 30 centimeters by 1 centimeter by 3 millimeters, for which the transmitter may be located 7.5 centimeters from the edge of the plate. In other implementations, the plate may be shortened to 22 centimeters. The closer receiver may be located approximately 8.5-10 centimeters from the transmitter and the receivers may be at a distance approximately 1 centimeter apart from one another. One suitable material for the sensor plate is titanium, which may have mechanical strength and other physical characteristics consistent with use in downhole applications. Additional surfaces of the sensor plate may also be incorporated into the exterior surface of the tool while being ignored as a media for wave propagation. The implementation of FIG. 1 is beneficial because, among other reasons, space requirements are not only much lower than existing systems, but also occupy non-critical space at the surface of the tool.

Figure 5:
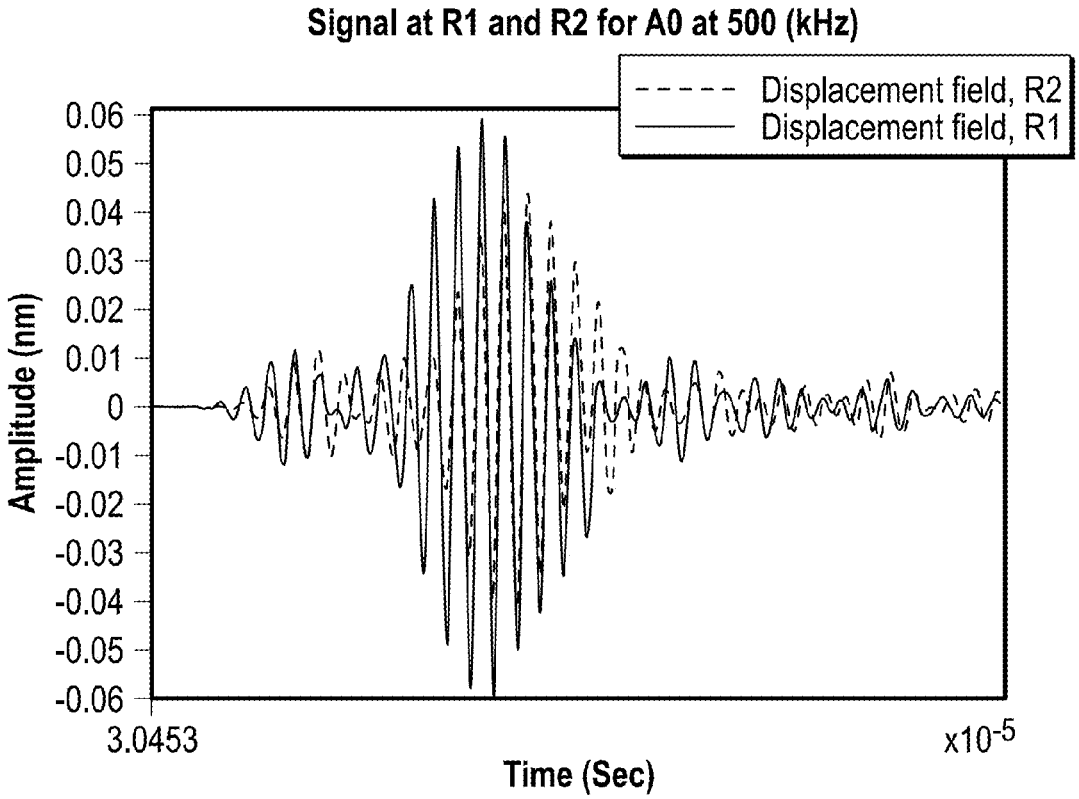
FIG. 5 shows a comparison between signals in the first and second receiver contrasting S0 and A0 wave modes.

FIG. 5 shows a comparison between signals in the first and second receiver contrasting S0 and A0 wave modes. Embodiments of the present disclosure may also use the S0 mode of the guided wave, which shows a significant advantage as a first arrival wave. However, the low attenuation associated with the S0 mode may produce higher levels of error in the estimated fluid impedance. Error with the A0 mode may be below 5 percent as shown in the simulated case modeling a 30 centimeter titanium plate immersed in a target fluid and a compensation fluid (water and oil) with an EMAT comb transducer transmitter located 7.5 centimeters from a first edge of the plate and two receivers located 10 and 11 centimeters from the transmitter, respectively.

Figure 6:
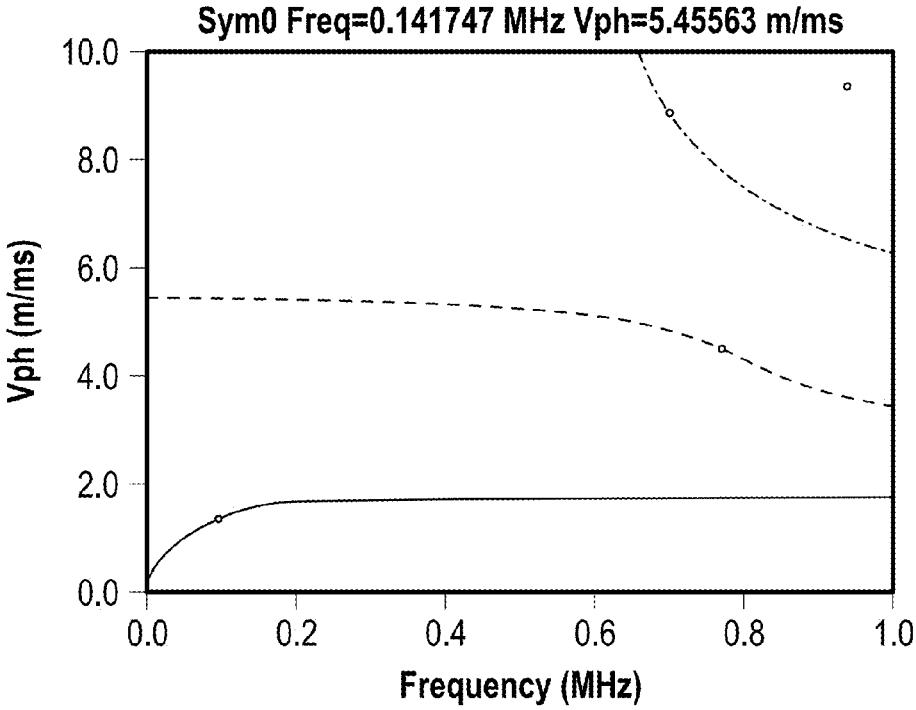
FIG. 6 illustrates phase velocity dispersion characteristics of a Scholte wave for a 3 millimeter titanium plate with respect to frequency.

Further embodiments of the present disclosure may use time of flight of guided waves in the sensor plate 104 to estimate the sound velocity of a fluid. A Scholte wave is a guided wave that propagates along a solid-fluid interface. The maximum velocity of Scholte wave ('interface wave') is determined by the lower of fluid wave velocity or solid transverse wave velocity. Thus, an appropriately selected transverse wave velocity in the solid will be higher than the maximum fluid wave velocity, and the velocity of the Scholte wave will be equal to fluid wave velocity. A Scholte wave may be excited at the interface of the target fluid (downhole fluid 102) and the sensor plate 104. The velocity of the wave may be measured based on its time of flight between receivers 120 and 122. This velocity will be the velocity of sound in the fluid. FIG. 6 illustrates phase velocity dispersion characteristics of a Scholte wave for a 3 millimeter titanium plate with respect to frequency.

As described above, particular aspects of wave behavior and the particular configuration of tool 100 may correspond to the parameter of interest to be estimated. Eliminating undesirable (non-interface) guided waves propagating in the plate is one challenge of Scholte wave use. For example, in addition to Scholte waves, leaky Lamb waves may be excited in the plate. These waves may propagate with higher velocity in the plate and overlap the Scholte waves. These propagation characteristics may impede separating the Scholte waves. One resolution to this complication exploits the differences in propagation characteristics between the waves. While Scholte waves need just one boundary for propagation, Lamb waves need both plate boundaries for propagation. Therefore, eliminating one boundary will eliminate the Lamb waves. In other embodiments, the presence of undesirable waves may be mitigated via signals processing or by other mechanical techniques.

Figure 7A:
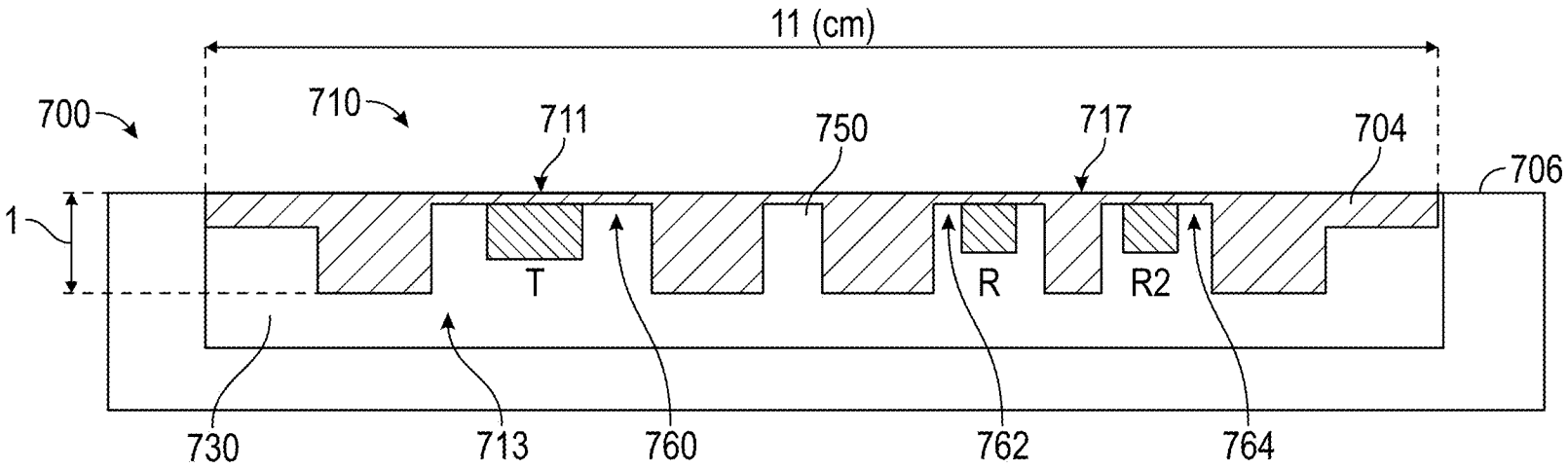
FIGS. 7A & 7B show other tools in accordance with embodiments of the present disclosure.
Figure 7B:
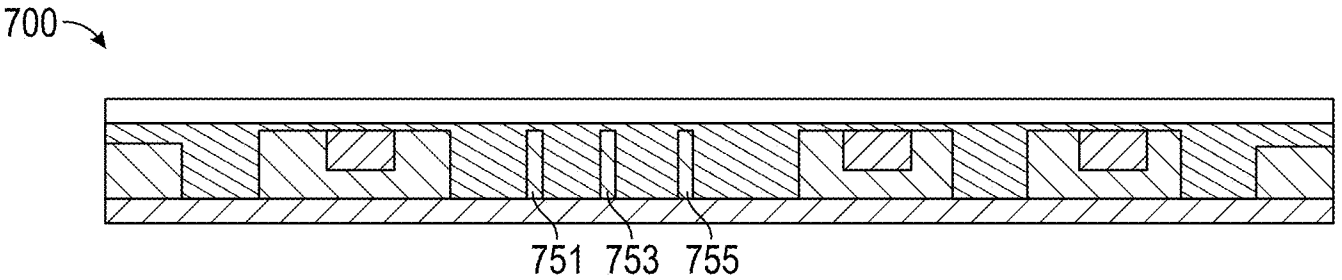

FIGS. 7A & 7B show other tools in accordance with embodiments of the present disclosure. Referring to FIG. 7A, tool 700 is similar to tool 700, including a tool body 706 having incorporated therein a sensor assembly 710 including a sensor plate 704 at the exterior of the tool body 706. The sensor plate 704 includes a surface 711 forming an exterior surface of the tool 700. However, tool 700 is configured to suppress (e.g., dampen, mitigate) Lamb waves using a signal filtering reservoir 750. Further, the acoustic transmitter 708 and acoustic receivers 720, 722 of sensor assembly 710 are located in corresponding sensor wells 760, 762, 764, to reduce the distance of the transmitter 708 and receivers 720, 722 from the interface 717.

As in tool 100, the tool 700 may also isolate an opposing surface 713 of the sensor plate 704 from the downhole fluid 702, and the opposing surface 713 may be in contact with a compensation fluid 730 (e.g., oil), so that the sensor plate 704 is exposed to fluid 702 on one side and compensation fluid on the other.

As above, the specific dimensions and material of the sensor plate may be environment and application specific. The number and dimensions of signal filtering reservoirs may vary. The area surrounding the reservoirs may be 1 centimeter thick. The ends of the plate may be configured with sufficient thickness (e.g., 3 millimeters) to provide structural stability for fastening of the plate to the tool body, and the width may facilitate retaining sufficient energy for a 3D waveguide. The thickness of the plate in the sensor wells (e.g., 1 millimeter) may be configured to provide high Scholte wave excitation. In one implementation, the plate may be 11 centimeters by 1 centimeter by 1 centimeter, for which the transmitter may be located 3 centimeters from the edge of the plate. The closer receivers may be located approximately 4 centimeters from the transmitter. The farther receiver may be approximately 1.5 centimeters from the closer receiver.

FIG. 7B illustrates a non-interface wave filter configuration comprising four filter blocks separated by three reservoirs 751, 753, 755. A simulation is conducted modeling a 16 centimeter titanium plate immersed in a target fluid and a compensation fluid with an EMAT comb transducer transmitter located 3.5 centimeters from a first edge of the plate and two receivers located 7 and 10 centimeters from the transmitter, respectively. Error in estimating sound velocity using the techniques herein may be below 5 percent as shown in the simulated case.

Figure 8:
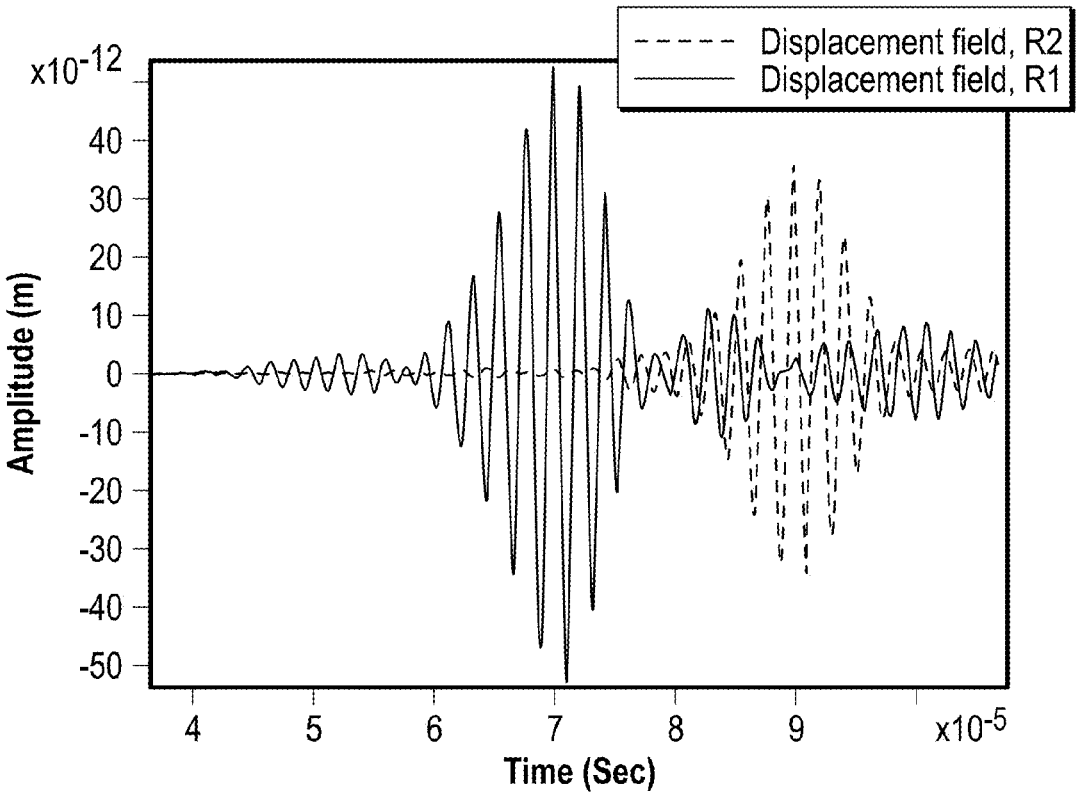
FIG. 8 illustrates an acoustic signal received at two receivers in accordance with embodiments of the present disclosure.

FIG. 8 illustrates an acoustic signal received at the two receivers 720 and 722 for a fluid with Cf=1500 [m/s] and ρ=1259 [kg/m^3]. The TOF between R1 and R2 is 20 microseconds and distance is 3 centimeters. Using this information the velocity of wave is derived as 1500 meters per second.

Figure 9A:
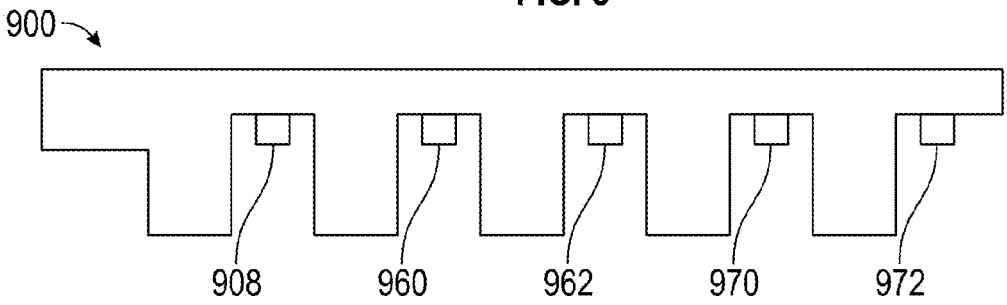
FIGS. 9A & 9B show other sensor arrays in accordance with embodiments of the present disclosure.
Figure 9B:
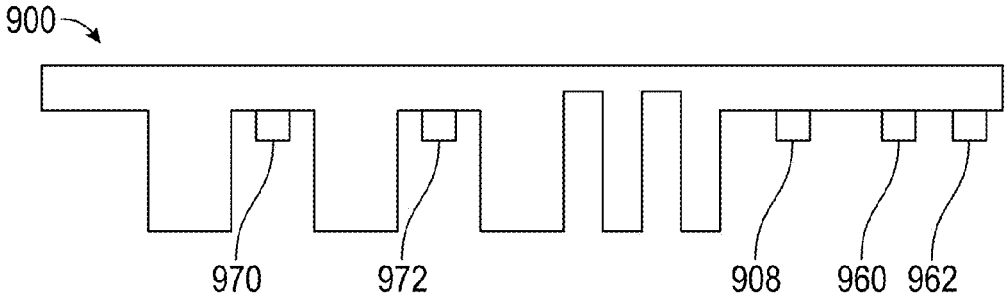

FIGS. 9A & 9B show other sensor arrays in accordance with embodiments of the present disclosure. Other embodiments may include specific receivers for measuring each wave mode. For example, FIGS. 9A & 9B include a transmitter 908, Lamb wave receivers 960, 962, and Scholte wave receivers 970, 972 in various configurations. In FIG.

9A, Lamb wave receivers 960, 962 each reside in a corresponding signal filtering reservoir.

Figure 10:
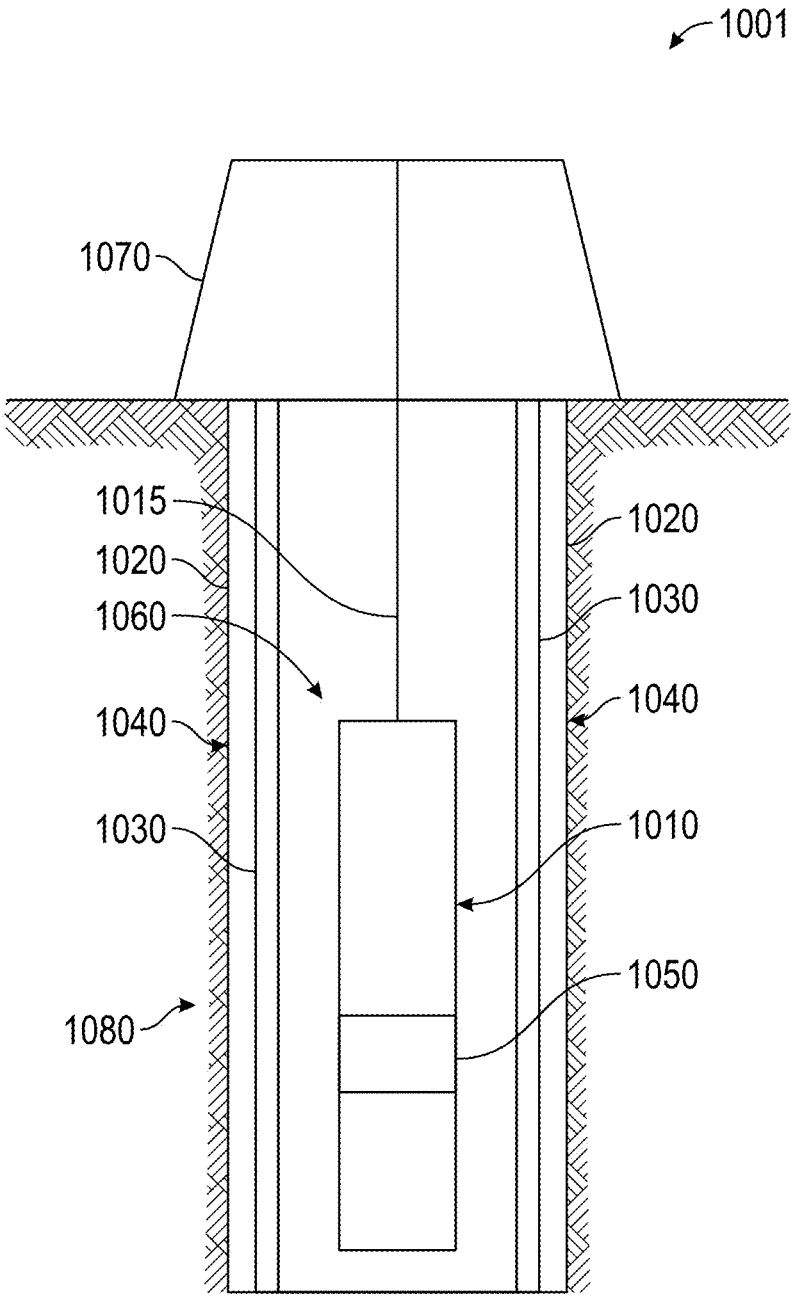
FIG. 10 illustrates a tool in accordance with embodiments of the present disclosure.

FIG. 10 illustrates a tool in accordance with embodiments of the present disclosure. The tool 1010 is configured to be conveyed in a borehole intersecting a formation 1080. The borehole wall 1040 is shown lined with casing 1030 filled with a downhole fluid 1060, such as, for example, drilling fluid. Cement 1020 fills the annulus between the borehole wall 1040 and the casing 1030. In other embodiments, the system may not have either or both of the casing and cement. For example, the borehole may be newly drilled.

In one illustrative embodiment, the tool 1010 may contain a sensor assembly 1050, including, for example, one or more acoustic transmitters and receivers (e.g., transducers), configured for evaluation of the cement bond existing between the system of the casing 1030, the borehole wall 1040, and the cement 1020 occupying the annular space between the casing and the borehole wall according to known techniques. For example, electronics in the tool 1010, at the surface, or elsewhere in system 1001 (e.g., at least one processor) may be configured to use acoustic measurements to determine properties of the cement bond using known techniques, such as, for example, analysis of casing resonance.

The system 1001 may include a conventional derrick 1070. A conveyance device (carrier 1015) which may be rigid or non-rigid, may be configured to convey the downhole tool 1010 into wellbore 1040 in proximity to formation 1080. The carrier 1015 may be a drill string, coiled tubing, a slickline, an e-line, a wireline, etc. Downhole tool 1010 may be coupled or combined with additional tools. Thus, depending on the configuration, the tool 1010 may be used during drilling and/or after the wellbore (borehole) 1040 has been formed. While a land system is shown, the teachings of the present disclosure may also be utilized in offshore or subsea applications. The carrier 1015 may include embedded conductors for power and/or data for providing signal and/or power communication between the surface and downhole equipment. The carrier 1015 may include a bottom hole assembly, which may include a drilling motor for rotating a drill bit to extend the borehole, and a system for circulating a suitable drilling fluid (also referred to as the "mud") under pressure.

As shown, plate 104 may be positioned substantially flush with the tool body 106. The substantially flush configuration reduces the likelihood of pack off (clogging by drilling mud solids) because the face is substantially the only part of the instrument in contact with the drilling fluid.

The system 1001 may include sensors, circuitry and processors for providing information about downhole measurements by the tool and control of the tool or other system components. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs, EEPROMs, Flash Memories, RAMs, Hard Drives and/or Optical disks. Other equipment such as power and data buses, power supplies, and the like will be apparent to one skilled in the art.

A point of novelty of the system is that the processors (at the surface and/or downhole) are configured to perform certain methods (discussed below) that are not in the prior art. More specifically, tool 1010 may include an apparatus for estimating one or more parameters of the downhole fluid, which may comprise tool 100, sensory assembly 110 or other devices or tools in accordance with embodiments of the present disclosure. In general embodiments, processors may be configured to use the apparatus to produce information indicative of the downhole fluid (e.g., drilling fluid). One of the processors may also be configured to estimate from the information a parameter of interest of the downhole fluid.

In some embodiments, processors may include electromechanical and/or electrical circuitry configured to carry out the methods disclosed herein. In other embodiments, processors may use algorithms and programming to receive information and control operation of the apparatus. Therefore, processors may include an information processor that is in data communication with a data storage medium and a processor memory. The data storage medium may be any standard computer data storage device, such as a USB drive, memory stick, hard disk, removable RAM, EPROMs, EAROMs, flash memories and optical disks or other commonly used memory storage system known to one of ordinary skill in the art including Internet based storage. The data storage medium may store one or more programs that when executed causes information processor to execute the disclosed method(s). Herein, "information" may include raw data, processed data, analog signals, and digital signals.

Figure 11:
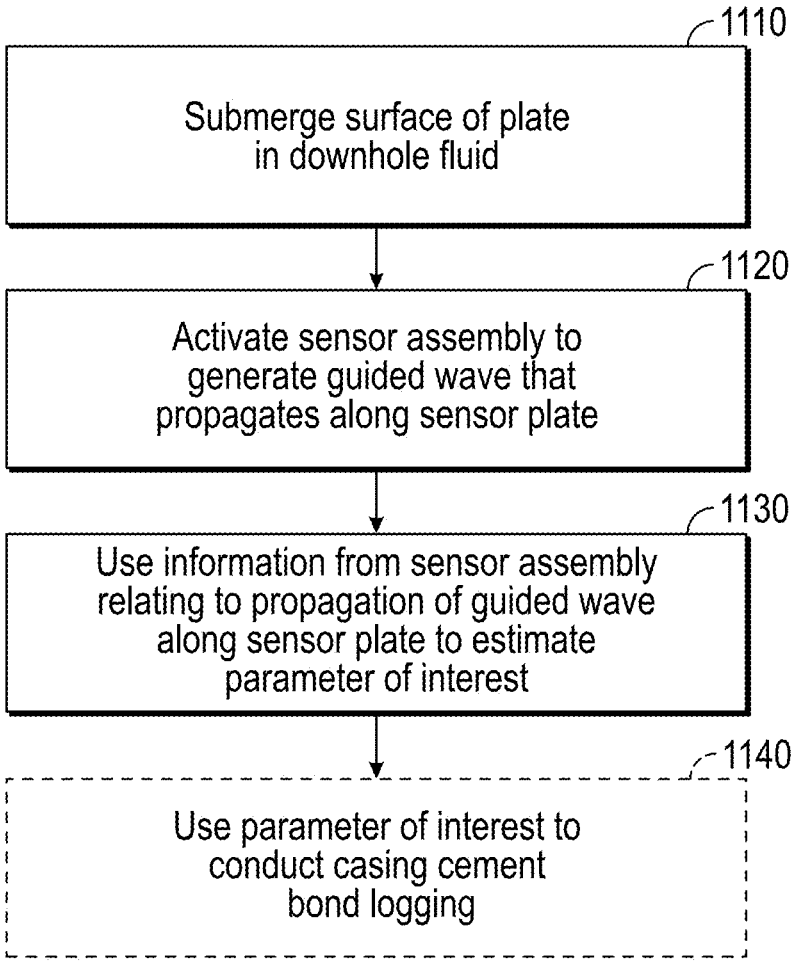
FIG. 11 illustrates a method of downhole evaluation using a tool including a sensor assembly in accordance with embodiments of the present disclosure.

FIG. 11 illustrates a method of downhole evaluation using a tool 100 including a sensor assembly 110 in accordance with embodiments of the present disclosure. Step 1110 includes submerging the surface of the sensor plate in a downhole fluid in a borehole. The downhole fluid may include drilling fluid, production fluid, formation fluids, other engineered fluids, and so on. Step 1110 may be carried out conveying the tool in the hole. For example, the tool may be conveyed on a wireline tool. Conversely, the tool may be conveyed on a drillstring having a drillbit disposed at the distal end thereof. In the case of a drillstring, conveying the tool in the borehole may include rotating the drillbit to extend the borehole and circulating drilling fluid in the borehole.

Step 1120 includes activating the sensor assembly to generate a guided wave that propagates along the sensor plate. Generating the guided wave may be carried out with an acoustic transmitter (e.g., 108) acoustically coupled to the sensor plate. As discussed above, propagation of the guided wave along the sensor plate is dependent upon one or more parameters of interest of the downhole fluid. The guided wave may be a Lamb wave, so the guided wave may propagate in the plate between the surface and an opposing surface of the plate. Alternatively, the guided wave may be a Scholte wave which propagates along the plate at the fluid-plate interface.

Step 1130 includes using information from the sensor assembly (e.g., receivers 120, 122) relating to the propagation of the guided wave along the sensor plate to estimate the parameter of interest. The information may be acquired, for example, by using an acoustic receiver acoustically coupled to the sensor plate. The sensor assembly may include at least a first acoustic receiver coupled to the plate at a first distance along the plate from the acoustic transmitter and a second acoustic receiver coupled to the plate at a second distance along the plate from the acoustic transmitter. Thus, step 1130 may include generating the information with the at least one acoustic receiver in response to the propagating guided wave. The information may relate to attenuation of the guided wave.

Figure 12:
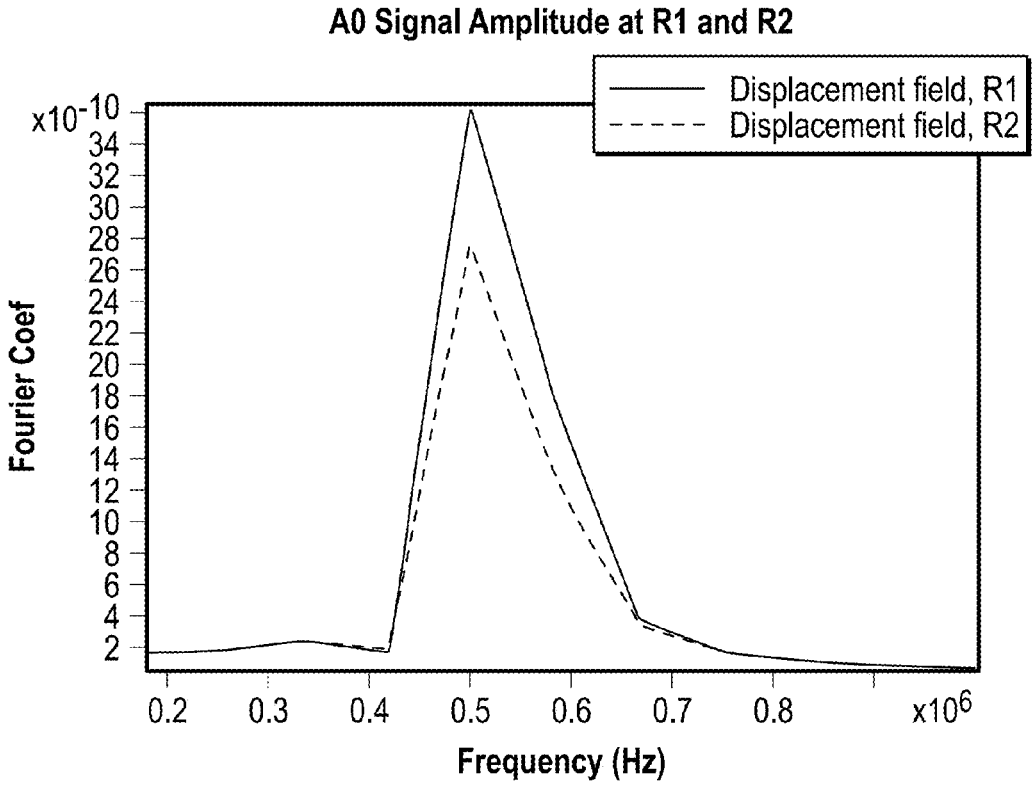
FIG. 12 shows a Fourier transform taken from the windowed signal.
Figure 13:
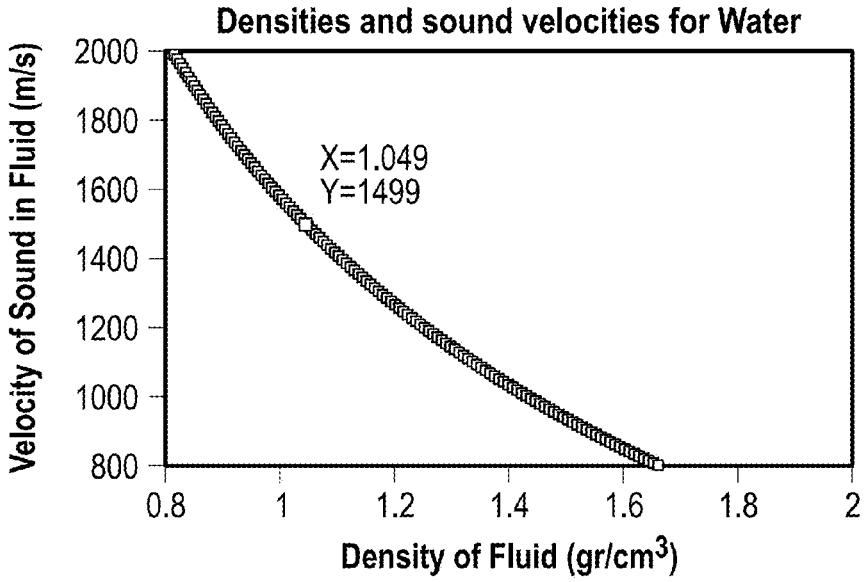
FIG. 13 shows a range of fluid properties that can provide a particular attenuation value.
Figure 14:
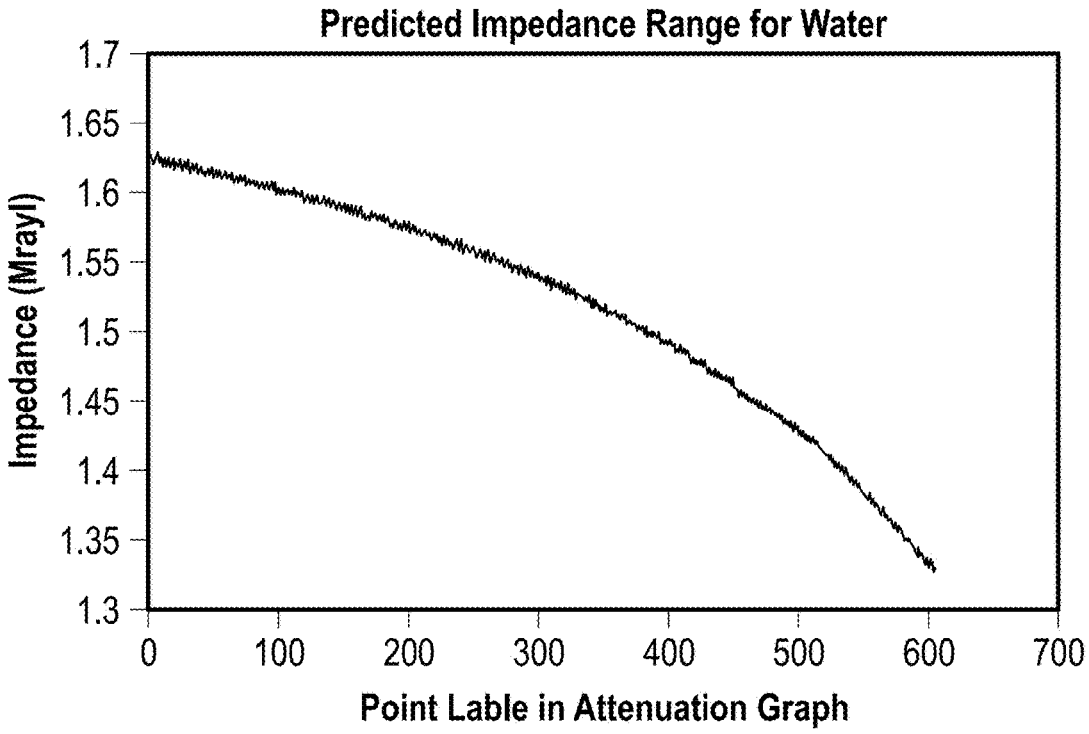
FIG. 14 shows the impedance range of a fluid.

In the case of fluid velocity (using a Scholte wave), the information relates to time of flight of the guided wave along the interface between the surface and the downhole fluid, and step 1130 includes estimating the sound velocity by dividing the travel time of the signal through the plate by the distance the signal traveled, such as, for example, the distance between receivers. In the other cases, step 1130 may include identifying a value of the parameter of interest by matching the information to an analytical solution. As one option, this may be carried out by storing synthetic responses corresponding to a range of fluid sound velocity and fluid impedance. The synthetic responses are an analytical solution (a theoretical prediction of attenuation) corresponding to value pairs within the metric space formed by the ranges. Referring again to FIG. 2A, the same time window of the A0 signal at each receiver may be selected. A Fourier transform may be taken from the windowed signal, as shown in FIG. 12. A ratio of the maximum amplitudes of the transforms (here, corresponding to 500 kHz) may be used to determine the A0 mode attenuation. The transform shows 2.0378 decibels per centimeter attenuation for A0. FIG. 13 shows the range of fluid properties that can provide this attenuation value. The impedance of the fluid may be estimated using only the attenuation magnitude. FIG. 14 shows the impedance range of the fluid to be from 1.32-1.62 MRayls, which estimates the impedance of water with 12% error. However, using attenuation magnitude and fluid sound velocity the impedance may be estimated with higher accuracy (error less than 5 percent).

If sound velocity is known, after estimating attenuation from the sensor measurement, fluid impedance may be determined by identifying the closest analytical solution. For example, a processor may use a look-up table to map responses to identify the fluid impedance. See FIG. 3. In some instances, finding the solution may be accomplished by interpolation between a plurality of close analytical solutions. Density of the fluid may also be determined from sound velocity and acoustic impedance according to known methods. Optional step 1140 includes using one or more of the parameters of interest for conducting casing cement bond logging.

Method embodiments described above may optionally estimate one or a plurality of parameters of interest of the downhole fluid. As described, estimation of each parameter may be carried out using a corresponding technique, such as, for example, the generation of a particular guided wave mode. Estimating a combination of parameters may include using the same transmitters and receivers at different times, using the same transmitters and receivers at different times, using different transmitters and receivers, using the same transmitter and different receivers, and so on. In some cases, estimating the combination of parameters may be carried out using different tools.

For convenience, certain definitions are now presented. The term "acoustic signal" relates to the pressure amplitude versus time of a sound wave or an acoustic wave traveling in a medium that allows propagation of such waves. In one embodiment, the acoustic signal can be a pulse. The term "acoustic transducer" relates to a device for transmitting (i.e., generating) an acoustic signal or receiving an acoustic signal. When receiving the acoustic signal in one embodiment, the acoustic transducer converts the energy of the acoustic signal into electrical energy. The electrical energy has a waveform that is related to a waveform of the acoustic signal.

The term "carrier" (or "conveyance device") as used above means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's, drill string inserts, modules, internal housings and substrate portions thereof, self-propelled tractors. As used above, the term "sub" refers to any structure that is configured to partially enclose, completely enclose, house, or support a device. The term "information" as used above includes any form of information (Analog, digital, EM, printed, etc.). The term "processor" herein includes, but is not limited to, any device that transmits, receives, manipulates, converts, calculates, modulates, transposes, carries, stores or otherwise utilizes information. A processor refers to any circuitry performing the above, and may include a microprocessor, resident memory, and/or peripherals for executing programmed instructions, application specific integrated circuits (ASICs), field programmable gate arrays (FPGAs), or any other circuitry configured to execute logic to perform methods as described herein. Fluid, as described herein, may refer to a liquid, a gas, a mixture, and so on. Predicted formation permeability and predicted formation mobility refer to values predicted for the formation and used to estimate the correction factor. Predicted values may be predicted from lithology, estimated from other estimation techniques, obtained by analogy, and so on, but are distinguished from parameters of interest estimating according to the methods disclosed herein.

Non-limiting examples of downhole fluids include drilling fluids, return fluids, formation fluids, production fluids containing one or more hydrocarbons, oils and solvents used in conjunction with downhole tools, water, brine, engineered fluids, and combinations thereof. Compensation fluid, as used herein, refers to fluid contributing to pressure compensation—that is, a fluid contributing to the structural or functional integrity of the tool under elevated pressures common in a borehole environment (e.g., 10-20 kilopascals).

Reservoir, as described herein, means a bulk material with large dimensions compared to the wavelength of acoustic waves propagating inside the reservoir. The bulk filter is used to eliminate those guided waves that need two boundaries for propagation.

While the disclosure has been described with reference to example embodiments, it will be understood that various changes may be made and equivalents may be substituted for elements thereof without departing from the scope of the disclosure. In addition, many modifications will be appreciated to adapt a particular instrument, situation or material to the teachings of the disclosure without departing from the essential scope thereof. Further embodiments may include direct measurement wireline embodiments, drilling embodiments employing a sample chamber, LWT tools, including drop subs and the like, and so on. While the present disclosure is discussed in the context of a hydrocarbon producing well, it should be understood that the present disclosure may be used in any borehole environment (e.g., a geothermal well) with any type of downhole fluid.

While the foregoing disclosure is directed to particular embodiments, various modifications will be apparent to those skilled in the art. It is intended that all variations be embraced by the foregoing disclosure.

What is claimed is:

1. A method of downhole evaluation using a sensor assembly that includes a sensor plate, wherein a surface of the sensor plate forms a portion of an exterior surface of a downhole tool, the method comprising:

submerging the surface of the sensor plate in a downhole fluid in a borehole;

activating the sensor assembly and generating a guided wave that propagates along the sensor plate subject to at least one boundary of propagation, the guided wave having a direction of propagation parallel with a longitudinal axis of the tool, wherein propagation of the guided wave along the sensor plate is dependent upon a parameter of interest of the downhole fluid;

using information from the sensor assembly relating to the propagation of the guided wave along the sensor plate to estimate the parameter of interest.

2. The method of claim 1 comprising isolating at least an opposing surface of the sensor plate from the downhole fluid.

3. The method of claim 1, wherein the information relates to attenuation of the guided wave.

4. The method of claim 3, wherein the guided wave propagates in the plate between the surface and an opposing surface of the plate.

5. The method of claim 1, wherein the guided wave is an interface guided wave.

6. The method of claim 5, wherein the information relates to time of flight of the guided wave along the interface between the surface and the downhole fluid.

7. The method of claim 1 wherein the tool is conveyed on a drillstring having a drillbit disposed at the distal end thereof and the downhole fluid comprises drilling fluid, the method comprising:

rotating the drillbit to extend the borehole; and circulating drilling fluid in the borehole.

8. The method of claim 1 wherein the sensor assembly includes an acoustic transmitter acoustically coupled to the plate, the method comprising generating the guided wave with the acoustic transmitter.

9. The method of claim 8 wherein the sensor assembly includes at least one acoustic receiver acoustically coupled to the plate, the method comprising generating the information with the at least one acoustic receiver in response to the propagating guided wave.

10. The method of claim 9 wherein at least one of the acoustic transmitter and the acoustic receiver is contained in compensation fluid.

11. The method of claim 8 wherein the sensor assembly includes at least a first acoustic receiver coupled to the plate at a first distance along the plate from the acoustic transmitter and a second acoustic receiver coupled to the plate at a second distance along the plate from the acoustic transmitter, wherein the first distance and the second distance are not the same, the method comprising generating the information in response to the propagating guided wave with at least the first acoustic receiver and the second acoustic receiver.

12. The method of claim 11 wherein the plate comprises a reservoir between the first acoustic receiver and the second acoustic receiver to mitigate non-interface waves.

13. The method of claim 12 wherein the reservoir contains another acoustic transmitter configured to generate non-interface waves in the plate.

14. The method of claim 1 wherein the guided wave is a Scholte wave.

15. The method of claim 1 comprising identifying a value of the parameter of interest by matching the information to an analytical solution.

16. The method of claim 1, wherein the parameter of interest is at least one of: i) sound velocity of the downhole fluid; ii) acoustic impedance of the downhole fluid; and iii) density of the downhole fluid.

17. The method of claim 16 further comprising using the parameter of interest for casing cement bond logging.

18. The method of claim 1 wherein the downhole fluid is exterior to the tool, and wherein propagation of the guided wave along the sensor plate is dependent upon a parameter of interest of the downhole fluid exterior to the tool.

19. An apparatus for downhole evaluation in a borehole intersecting an earth formation, the apparatus comprising:

a carrier configured to be conveyed into a borehole filled with downhole fluid;

a logging tool mounted on the carrier, the logging tool including:

a plate having an exterior surface configured to be submerged in the downhole fluid;

a transmitter coupled to the plate;

at least one receiver coupled to the plate;

wherein the logging tool is configured such that when the borehole is filled with downhole fluid, the surface is immersed in the downhole fluid; and at least one processor configured to:

use the transmitter to generate a guided wave in the plate that propagates along the plate subject to at least one boundary of propagation, the guided wave having a direction of propagation parallel with a longitudinal axis of the tool; and use information from the at least one receiver relating to propagation of the guided wave along the plate to estimate the parameter of interest.

* * * * *